US008445422B2

(12) United States Patent
Gonzales et al.

(10) Patent No.: US 8,445,422 B2
(45) Date of Patent: May 21, 2013

(54) LIQUID CLEANING COMPOSITION

(75) Inventors: Denis Alfred Gonzales, Brussels (BE); Christopher Charles Graham, Ellington (GB); Colin Stephenson, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 105 days.

(21) Appl. No.: 13/236,678

(22) Filed: Sep. 20, 2011

(65) Prior Publication Data

US 2012/0071378 A1 Mar. 22, 2012

(30) Foreign Application Priority Data

Sep. 21, 2010 (EP) ..... 10177814

(51) Int. Cl.

| | |
|---|---|
| ***C11D 1/00*** | (2006.01) |
| ***C11D 3/22*** | (2006.01) |
| ***C11D 3/42*** | (2006.01) |
| ***C11D 17/00*** | (2006.01) |

(52) U.S. Cl.

USPC ..... 510/397; 510/189; 510/235; 510/238; 510/191; 510/275; 510/349; 510/441; 510/470; 510/471

(58) Field of Classification Search

USPC ..... 510/189, 235, 238, 191, 275, 349, 510/397, 441, 470, 471; 134/25.2, 42

See application file for complete search history.

(56) References Cited

U.S. PATENT DOCUMENTS

| | | | | |
|---|---|---|---|---|
| 1,621,906 | A | | 3/1927 | Schlcss |
| 2,082,275 | A | | 6/1937 | Daimler et al. |
| 2,084,632 | A | | 6/1937 | Ellis |
| 2,255,082 | A | | 9/1941 | Orthner et al. |
| 2,438,091 | A | | 3/1948 | Lynch |
| 2,528,378 | A | | 10/1950 | Mannheimer |
| 2,658,072 | A | | 11/1953 | Kosmin |
| 2,702,279 | A | | 2/1955 | Funderburk et al. |
| 3,070,510 | A | | 12/1962 | Cooley et al. |
| 3,586,715 | A | | 6/1971 | Smeets |
| 3,812,044 | A | | 5/1974 | Connor et al. |
| 3,915,903 | A | | 10/1975 | Wise |
| 3,929,678 | A | | 12/1975 | Laughlin et al. |
| 3,985,668 | A | | 10/1976 | Hartman |
| 4,025,444 | A | | 5/1977 | Murphy et al. |
| 4,051,056 | A | | 9/1977 | Hartman |
| 4,088,620 | A | | 5/1978 | Nihongi et al. |
| 4,102,992 | A | | 7/1978 | Davis |
| 4,240,919 | A | | 12/1980 | Chapman |
| 4,298,490 | A | | 11/1981 | Lange et al. |
| 4,309,316 | A | | 1/1982 | Lange et al. |
| 4,473,611 | A | | 9/1984 | Haq |
| 4,481,126 | A | | 11/1984 | Trinh et al. |
| 4,537,604 | A | | 8/1985 | Dawson |
| 4,565,644 | A | | 1/1986 | Smith et al. |
| 4,565,647 | A | | 1/1986 | Llenado |
| 4,581,385 | A | | 4/1986 | Smith et al. |
| 4,657,692 | A | | 4/1987 | Choy et al. |
| 4,663,069 | A | | 5/1987 | Llenado |
| 4,676,920 | A | | 6/1987 | Culshaw |
| 4,704,233 | A | | 11/1987 | Hartman et al. |
| 4,767,563 | A | | 8/1988 | De Buzzaccarini |
| 4,772,425 | A | | 9/1988 | Chirash et al. |
| 4,786,432 | A | * | 11/1988 | Kanfer et al. ..... 510/399 |
| 4,842,763 | A | | 6/1989 | Troger et al. |
| 4,906,396 | A | | 3/1990 | Falholt et al. |
| 5,287,207 | A | | 2/1994 | Mulkens et al. |
| 5,500,451 | A | | 3/1996 | Goldman et al. |
| 5,776,872 | A | | 7/1998 | Giret et al. |
| 5,776,878 | A | | 7/1998 | Theon |
| 5,798,505 | A | | 8/1998 | Lee |
| 5,821,214 | A | | 10/1998 | Weibel |
| 5,830,445 | A | | 11/1998 | Bouillon et al. |
| 5,883,062 | A | | 3/1999 | Addison et al. |
| 5,898,026 | A | | 4/1999 | Yianakopoulos et al. |
| 5,906,973 | A | | 5/1999 | Ouzounis et al. |
| 6,008,181 | A | | 12/1999 | Cripe et al. |
| 6,020,303 | A | | 2/2000 | Cripe et al. |
| 6,060,443 | A | | 5/2000 | Cripe et al. |
| 6,080,707 | A | | 6/2000 | Glenn et al. |
| 6,132,212 | A | | 10/2000 | Horiguchi et al. |
| 6,221,829 | B1 | | 4/2001 | Symes et al. |
| 6,242,405 | B1 | | 6/2001 | Lykke et al. |
| 6,265,363 | B1 | | 7/2001 | Viscovitz |
| 6,268,325 | B1 | | 7/2001 | Luciani et al. |
| 6,274,540 | B1 | | 8/2001 | Scheibel et al. |
| 6,299,746 | B1 | | 10/2001 | Conte et al. |
| 6,306,817 | B1 | | 10/2001 | Kott et al. |
| 6,359,031 | B1 | | 3/2002 | Lykke et al. |
| 6,369,121 | B1 | | 4/2002 | Catalfamo et al. |
| 6,444,716 | B1 | | 9/2002 | Hird et al. |
| 6,514,926 | B1 | | 2/2003 | Kott et al. |
| 6,525,233 | B1 | | 2/2003 | Connor et al. |
| 6,537,957 | B1 | | 3/2003 | Cardola et al. |
| 6,566,319 | B1 | | 5/2003 | Scheibel et al. |
| 6,583,096 | B1 | | 6/2003 | Kott et al. |
| 6,593,285 | B1 | | 7/2003 | Scheibel et al. |
| 6,602,840 | B1 | | 8/2003 | Scheibel et al. |

(Continued)

FOREIGN PATENT DOCUMENTS

| | | | |
|---|---|---|---|
| DE | 24 10 425 | A1 | 10/1974 |
| DE | 10 2004 038771 | A1 | 8/2005 |

(Continued)

OTHER PUBLICATIONS

ASTM Designation: F1877-05 Jun. 10, 2009; Standard Practice for Characterization of Particles; 14 pages; chapter 11.3.6; Section 11.3.2.

(Continued)

*Primary Examiner* — Gregory Delcotto

(74) *Attorney, Agent, or Firm* — John T. Dipre; Steven W. Miller

(57) ABSTRACT

The present invention relates to a liquid, cleaning composition comprising abrasive cleaning particles.

17 Claims, No Drawings

U.S. PATENT DOCUMENTS

| | | | |
|---|---|---|---|
| 6,699,963 | B2 | 3/2004 | Noda et al. |
| 6,749,066 | B2 | 6/2004 | Bergman |
| 6,759,377 | B2 | 7/2004 | Hackenthal et al. |
| 6,767,878 | B1 | 7/2004 | Paye et al. |
| 6,808,759 | B1 | 10/2004 | Okumura et al. |
| 6,858,216 | B2 | 2/2005 | Schulze zur Wiesche et al. |
| 7,307,055 | B2 | 12/2007 | Cook et al. |
| 7,393,820 | B2 | 7/2008 | Soldanski et al. |
| 7,713,921 | B2 | 5/2010 | Boutique et al. |
| 7,994,111 | B2 | 8/2011 | Caggioni et al. |
| 2002/0137647 | A1 | 9/2002 | Hackenthal et al. |
| 2002/0166832 | A1 | 11/2002 | Silud et al. |
| 2002/0173243 | A1 | 11/2002 | Costas et al. |
| 2003/0176633 | A1 | 9/2003 | Noda et al. |
| 2003/0215417 | A1 | 11/2003 | Uchiyama et al. |
| 2004/0216388 | A1 | 11/2004 | Mathur et al. |
| 2004/0266645 | A1 | 12/2004 | Albrecht et al. |
| 2005/0065056 | A1 | 3/2005 | Cook et al. |
| 2005/0130873 | A1 | 6/2005 | Cheung et al. |
| 2005/0170979 | A1 | 8/2005 | Massaro et al. |
| 2005/0201965 | A1 | 9/2005 | Kuhlman et al. |
| 2006/0011885 | A1 | 1/2006 | Christmas et al. |
| 2006/0094635 | A1 | 5/2006 | Pereira |
| 2006/0177488 | A1 | 8/2006 | Caruso et al. |
| 2007/0006391 | A1 | 1/2007 | Ghosh et al. |
| 2007/0010415 | A1 | 1/2007 | Kinscherf et al. |
| 2007/0041927 | A1 | 2/2007 | Blaeser et al. |
| 2007/0043147 | A1 | 2/2007 | Higgins et al. |
| 2007/0135645 | A1 | 6/2007 | Ignatyev et al. |
| 2007/0138671 | A1 | 6/2007 | Anastasiou et al. |
| 2007/0167345 | A1 | 7/2007 | Soldanski et al. |
| 2007/0191256 | A1 | 8/2007 | Fossum et al. |
| 2007/0270730 | A1 | 11/2007 | Rische et al. |
| 2008/0013972 | A1 | 1/2008 | Matsuda |
| 2008/0108714 | A1 | 5/2008 | Swazey et al. |
| 2008/0149137 | A1 | 6/2008 | Steinbrenner et al. |
| 2008/0248144 | A1 | 10/2008 | Guenter et al. |
| 2009/0176935 | A1 | 7/2009 | Boeckh et al. |
| 2009/0253816 | A1 | 10/2009 | Nascimento et al. |
| 2009/0291306 | A1 | 11/2009 | Quadbeck-Seeger |
| 2009/0325837 | A1 | 12/2009 | Mundschau et al. |
| 2010/0081604 | A1 | 4/2010 | Barger et al. |
| 2010/0081605 | A1 | 4/2010 | Barger et al. |
| 2010/0081606 | A1 | 4/2010 | Barger et al. |
| 2010/0197553 | A1 | 8/2010 | Barnabas et al. |
| 2011/0021398 | A1 | 1/2011 | Allef et al. |
| 2011/0039744 | A1 | 2/2011 | Heath et al. |
| 2011/0150787 | A1 | 6/2011 | Gonzales et al. |
| 2011/0150788 | A1 | 6/2011 | Gonzales et al. |
| 2011/0150949 | A1 | 6/2011 | Gonzales et al. |
| 2011/0150950 | A1 | 6/2011 | Gonzales et al. |
| 2011/0150951 | A1 | 6/2011 | Gonzales et al. |
| 2011/0178196 | A1 | 7/2011 | Steinke et al. |
| 2011/0189414 | A1 | 8/2011 | Whitehouse |
| 2011/0262371 | A1 | 10/2011 | Deleersnyder et al. |
| 2011/0262504 | A1 | 10/2011 | Deleersnyder et al. |
| 2011/0287105 | A1 | 11/2011 | Gittleman |
| 2012/0029519 | A1 | 2/2012 | Sengun et al. |
| 2012/0066851 | A1 | 3/2012 | Gonzales et al. |
| 2012/0071379 | A1 | 3/2012 | Gonzales et al. |
| 2012/0071380 | A1 | 3/2012 | Gonzales et al. |
| 2012/0071383 | A1 | 3/2012 | Perez-Prat Vinucsa et al. |
| 2012/0202730 | A1 | 8/2012 | Allef et al. |

FOREIGN PATENT DOCUMENTS

| | | | |
|---|---|---|---|
| DE | 10 2005 023801 | A1 | 11/2006 |
| EP | 1 136 063 | A2 | 9/2001 |
| EP | 1136063 | A2 | 9/2001 |
| EP | 1 460 125 | A1 | 9/2004 |
| GB | 1082179 | A | 9/1967 |
| GB | 2 001 099 | A | 1/1979 |
| GB | 2 126 999 | A | 4/1984 |
| GB | 2 145 729 | A | 4/1985 |
| JP | 59192526 | A | 10/1984 |
| JP | 59192526 | A | 10/1984 |
| JP | 10025239 | A | 1/1998 |
| JP | 2005 296822 | A | 10/2005 |
| JP | 2007 077311 | A | 3/2007 |
| JP | 2009 160717 | A | 7/2009 |
| WO | WO 91/14420 | A1 | 10/1991 |
| WO | WO 99/05084 | A1 | 2/1999 |
| WO | WO 99/52500 | A1 | 10/1999 |
| WO | WO 01/31110 | A1 | 5/2001 |
| WO | 02/38720 | A1 | 5/2002 |
| WO | WO-2004/071483 | A1 | 8/2004 |
| WO | WO 2004/071483 | A1 | 8/2004 |
| WO | WO 2008/109270 | A1 | 9/2008 |

OTHER PUBLICATIONS

International Standard; ISO 9276-6:2008(E) section 8.2; section 7; Representation of results of particle size analysis—Part 6: Descriptive and quantitative representation of particle shape and morphology, (2009).

"Vegetable Ivory", W.P. Armstrong, (http://waynesword.palomar.edu/pljan99.htm), (Jul. 2010).

"Phytelephas", Wikipedia.org (http://en.wikipedia.org/wiki/Phytelephas), (Nov. 2012).

U.S. Appl. No. 13/517,837, filed Jun. 14, 2012, Gonzales, et al.

U.S. Appl. No. 13/517,728, filed Jun. 14, 2012, Gonzales, et al.

U.S. Appl. No. 13/526,592, filed Jun. 19, 2012, Gonzales, et al.

U.S. Appl. No. 13/526,596, filed Jun. 19, 2012, Gonzales, et al.

U.S. Appl. No. 13/517,746, filed Jun. 14, 2012, Gonzales, et al.

U.S. Appl. No. 13/526,605, filed Jun. 19, 2012, Gonzales, et al.

U.S. Appl. No. 13/526,613, filed Jun. 19, 2012, Gonzales, et al.

U.S. Appl. No. 13/517,762, filed Jun. 14, 2012, Perez-Prat Vinuesa, et al.

U.S. Appl. No. 13/621,858, filed Sep. 18, 2012, Gonzales, et al.

U.S. Appl. No. 13/621,860, filed Sep. 18, 2012, Perez-Prat Vinuesa, et al.

EP International Search Report, dated Jan. 30, 2012 (7 pages).

PCT International Search Report, mailed Jan. 30, 2012 (12 pages).

Fukuda et al, "Mfg. Thermoplastic Resin Article Contg. Wood Powder—by Heating Liq. Thermosetting Resin, Grinding Cured Mixt., Adding to Thermoplastic Resin, etc.", EPI/Thomson, vol. 1984, No. 50, Oct. 31, 1984 Abstract.

* cited by examiner

LIQUID CLEANING COMPOSITION

TECHNICAL FIELD

The present invention relates to liquid compositions for cleaning a variety of inanimate surfaces, including hard surfaces in and around the house, dish surfaces, car and vehicles surfaces, etc. More specifically, the present invention relates to liquid scouring composition comprising suitable particles for cleaning and/or cleansing.

BACKGROUND OF THE INVENTION

Scouring compositions such as particulate compositions or liquid (incl. gel, paste-type) compositions containing abrasive components are well known in the art. Such compositions are used for cleaning a variety of surfaces; especially those surfaces that tend to become soiled with difficult to remove stains and soils.

Amongst the currently known scouring compositions, the most popular ones are based on abrasive particles with shapes varying from spherical to irregular. The most common abrasive particles are either inorganic like carbonate salt, clay, silica, silicate, shale ash, perlite and quartz sand or organic polymeric beads like polypropylene, PVC, melamine, urea, polyacrylate and derivatives, and come in the form of liquid composition having a creamy consistency with the abrasive particles suspended therein.

The surface safety profile of such currently known scouring compositions is inadequate alternatively, poor cleaning performances is shown for compositions with an adequate surface safety profile. Indeed, due to the presence of very hard abrasive particles, these compositions can damage, i.e., scratch, the surfaces onto which they have been applied. Indeed, the formulator needs to choose between good cleaning performance but featuring strong surface damage or compromising on the cleaning performance while featuring acceptable surface safety profile. In addition, such currently known scouring compositions at least in certain fields of application (e.g., hard surface cleaning) are perceived by consumers as outdated.

One type of suitable abrasive particles are natural particles such as nut shell particles and vegetable particles. Natural particles have undesired brownish color and a small amount of these particles tend to turn the cleaning liquid to brown color which is aesthetically undesired effect. During cleaning, it is observed that residual brown particles left on the surface leave dark residue that compromises the overall cleaning efficiency of the cleaning products. The use of coated abrasive particles is therefore preferred and improves final cleaning results.

Additionally brown colored particles are more visible in a cleaning liquid than white colored and therefore white colored abrasive particles are more preferred. This is due white colored particle's ability to improve final cleaning results and their aesthetic features.

It is thus an objective of the present invention to provide a liquid cleaning composition suitable to clean a variety of surfaces, including inanimate surfaces, such hard surfaces in and around the house, dish surfaces, etc., wherein the composition provides good cleaning performance, whilst providing a good surface safety profile. It is another objective of the present invention is to provide aesthetically acceptable cleaning composition comprising abrasive cleaning particles to improve cleaning performance.

It has been found that the above objectives are met by the composition according to the present invention.

It is an advantage of the compositions according to the present invention that they may be used to clean inanimate surfaces made of a variety of materials like glazed and non-glazed ceramic tiles, enamel, stainless steel, Inox®, Formica®, vinyl, no-wax vinyl, linoleum, melamine, glass, plastics, painted surfaces and the like.

A further advantage of the present invention is that in the compositions herein, the particles can be formulated at very low levels, whilst still providing the above benefits. Indeed, in general for other technologies, high levels of abrasive particles are needed to reach good cleaning performance, thus leading to high formulation and process cost, difficult rinse and end cleaning profiles, as well as limitation for aesthetics and a pleasant hand feel of the cleaning composition.

SUMMARY OF THE INVENTION

The present invention relates to a liquid cleaning composition comprising coated cleaning particles as abrasives, wherein said coated cleaning particles are selected from the group consisting coated nut shell particles, coated particles derived from other plant parts, coated wood particles and mixtures thereof, and wherein coated abrasive cleaning particles have a degree of whiteness (L*) of greater than 65, measured under D 65 illumination.

The present invention further encompasses a process of cleaning a surface with a liquid, composition comprising coated abrasive cleaning particles, wherein said surface is contacted with said composition, preferably wherein said composition is applied onto said surface.

DETAILED DESCRIPTION OF THE INVENTION

The Liquid Cleaning Composition

The compositions according to the present invention are designed as cleaners for a variety of inanimate surfaces.

In a preferred embodiment, the compositions herein are suitable for cleaning inanimate surfaces selected from the group consisting of household hard surfaces; dish surfaces; surfaces like leather or synthetic leather; and automotive vehicles surfaces.

By "household hard surface", it is meant herein any kind of surface typically found in and around houses like kitchens, bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, Inox®, Formica®, vitroceramic, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

By "dish surfaces" it is meant herein any kind of surfaces found in dish cleaning, such as dishes, cutlery, cutting boards, pots, pans, and the like made of different materials like stainless steel, glass, ceramic, china, metal, any plastics, wood, and Teflon. Such dish surfaces may be found both in private households as well as in commercial, institutional and industrial environments.

The compositions according to the present invention are liquid compositions as opposed to a solid or a gas. Liquid compositions include compositions having a water-like viscosity as well as thickened compositions, such as gels and pastes.

In a preferred embodiment herein, the liquid compositions herein are aqueous compositions. Therefore, they may comprise from 30% to 99.5% by weight of the total composition of water, preferably from 35% to 98% and more preferably from 40% to 95%.

In another preferred embodiment herein, the liquid compositions herein are mostly non-aqueous compositions although they may comprise from 0% to 10% by weight of the total composition of water, preferably from 0% to 5%, more preferably from 0% to 1% and most preferably 0% by weight of the total composition of water.

In a preferred embodiment herein, the compositions herein are neutral compositions, and thus have a pH, as is measured at 25° C., of 6-10, more preferably 6.5-9.5, even more preferably 7-9.

In other preferred embodiment compositions have pH preferably above pH 4 and alternatively have pH preferably below pH 9.5.

Accordingly, the compositions herein may comprise suitable bases and acids to adjust the pH.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, all available carbonate salts such as $K_2CO_3$, $Na_2CO_3$, $CaCO_3$, $MgCO_3$, etc., alkanolamines (as e.g. monoethanolamine), urea and urea derivatives, polyamine, etc.

Typical levels of such bases, when present, are of from 0.01% to 5.0%, preferably from 0.05% to 3.0% and more preferably from 0.1% to 0.6% by weight of the total composition.

The compositions herein may comprise an acid to trim its pH to the required level, despite the presence of an acid, if any, the compositions herein will maintain their neutral to alkaline, preferably alkaline, pH as described herein above. A suitable acid for use herein is an organic and/or an inorganic acid. A preferred organic acid for use herein has a pKa of less than 6. A suitable organic acid is selected from the group consisting of citric acid, lactic acid, glycolic acid, succinic acid, glutaric acid and adipic acid and a mixture thereof. A mixture of said acids may be commercially available from BASF under the trade name Sokalan® DCS. A suitable inorganic acid is selected from the group consisting hydrochloric acid, sulphuric acid, phosphoric acid and a mixture thereof.

A typical level of such an acid, when present, is of from 0.01% to 5.0%, preferably from 0.04% to 3.0% and more preferably from 0.05% to 1.5% by weight of the total composition.

In a preferred embodiment according to the present invention the compositions herein are thickened compositions. Preferably, the liquid compositions herein have a viscosity of up to 7500 cps at 20 $s^{-1}$, more preferably from 5000 cps to 50 cps, yet more preferably from 2000 cps to 50 cps and most preferably from 1500 cps to 300 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes).

In another preferred embodiment according to the present invention the compositions herein have a water-like viscosity. By "water-like viscosity" it is meant herein a viscosity that is close to that of water. Preferably the liquid compositions herein have a viscosity of up to 50 cps at 60 rpm, more preferably from 0 cps to 30 cps, yet more preferably from 0 cps to 20 cps and most preferably from 0 cps to 10 cps at 60 rpm and 20° C. when measured with a Brookfield digital viscometer model DV II, with spindle 2.

Abrasive Cleaning Particles

The liquid cleaning composition herein comprise abrasive cleaning particles formed by shearing and/or grinding nut shell, or other plant parts. By other plant parts are meant such as, but not limited to stems, roots, leaves, seeds, roots and mixtures thereof. Wood can also be used to produce the abrasive cleaning particles of the present composition.

Preferably nut shell is selected from the group consisting of pistachio nut shell, walnut shell, almond shell and mixtures thereof. Preferably nut shell is pistachio nut shell or walnut shell.

When other plant parts are used to produce the cleaning particles of the present invention, they are preferably derived from rice, corn cob, palm biomass, bamboo, kenaf, apple seeds, apricot stone, olive stone and mixtures thereof. When other plant parts are used, preferably cleaning particles are produced from olive stone.

The abrasive particles used herein are coated.

Various well-known coating processes may be used. Most commonly whitening dye or pigment is deposited to the surface of the particle. The efficiency of the deposition process can be increased by embedding the whitening dye or pigment in a carrier (binder, resins, polymer, waxes, etc.). The coating process by using whitening dye/pigment and carrier mix can be achieved via solvent or emulsion, followed by evaporation or precipitation, melt or layer-by-layer deposition by using electrolyte polymer eg.: via successive additions of aqueous solution of positively charged polymer e.g.: poly(diallyldimethylammonium chloride) and polystyrene sulfonate with or without the presence of pigment in the polyelectrolyte solution. Process using spray-coating are particularly preferred.

Preferably the coating material layer contains whitening pigments whereas pigments are selected from the group consisting of titanium dioxide, kaolin, metal carbonate or mixtures thereof. Preferably the metal carbonate is calcium carbonate.

Preferably the coating material layer of the nut shell and/or vegetable particles is from 1 μm to 40 μm, preferably from 1 μm to 20 μm more preferably from 1 μm 10 μm. The thickness of the coating layer is measured from sliced material by scanning electron microscopy.

It has surprisingly been found that the abrasive cleaning particles of the present invention show a good cleaning performance even at relatively low levels, such as preferably from 0.1% to 20%, preferably from 0.1% to 10%, more preferably from 0.5% to 5%, even more preferably from 0.5% to 3%, by weight of the total composition of said abrasive cleaning particles.

The abrasive particles are preferable color stable particles. By "color stable" it is meant herein that color of the particles used in the present invention will substantially not turn yellow during storage and use.

The particles used in the present invention are preferably white having whiteness degree of whiteness (L*) of greater than 65, preferably above 75, measured under D 65 illumination.

Additionally suitable color stabilizing agents can be used to stabilize desired color and/or whiteness.

As used herein, the term "degree of whiteness (L*)" means the whiteness value of a tableted sample measured using Gretag Machbeath™ 7000 a color-eye instrument or equivalent used in reflectance mode. This instrument provides a choice of light sources; "D65" represents roughly a mid-day sun in western and northern Europe, whilst "illuminant A" is intended to represent typical, domestic, tungsten-filament lighting and "CWF2" represents cool white fluorescent. The instrument thus provides a standard measure of whiteness (L*) that can be determined for daylight, tungsten and fluorescent lighting conditions. Under each set of lightning conditions L* is defined such that 100 is fully white and 0 has no white components. For the purposes of the present invention, the "D65" illuminant is used to measure whiteness.

Whiteness Measurement:

Whiteness (L*) was measured using Gretag Macbeath 7000 a color-eye instrument in reflectance mode with the "D65" light source representing roughly a mid-day sun in western and northern Europe.

Samples were prepared by filling coated nut shell particles in a holder to ensure good packing of the particle so to make a continuous layer of material. Measurements were made by placing the tabled in the holder of the color-eye instrument. The area if view was 3 mm by 8 mm with degree observer angle 10°. The specular component was included. Measurements were generally made duplicate and an average was taken.

In a preferred embodiment the abrasive cleaning particles are preferably non-rolling. Alternatively in another preferred embodiment the abrasive cleaning particles are preferably sharp. By non-rolling is meant that the abrasive cleaning particle and the surface are in contact with each other by sliding.

Indeed the applicant has found that non-rolling and/or sharp abrasive cleaning particles provide good soil removal.

In a preferred embodiment, the abrasive cleaning particles have a mean ECD from 10 μm to 1000 μm, preferably from 50 μm to 500 μm, more preferably from 100 μm to 350 μm and most preferably from 150 to 250 μm.

Indeed, the Applicant has found that the abrasive particle size can be critical to achieve efficient cleaning performance whereas excessively abrasive population with small particle sizes e.g.: typically below 10 micrometers feature polishing action vs. cleaning despite featuring a high number of particles per particle load in cleaner inherent to the small particle size. On the other hand, abrasive population with excessively high particle size, e.g.: above 1000 micrometers, do not deliver optimal cleaning efficiency, because the number of particles per particle load in cleaner, decreases significantly inherently to the large particle size. Additionally, excessively small particle size are not desirable in cleaning task since in practice, small and numerous particles are often hard to remove from the various surface topologies which requires excessive effort to remove from the user unless leaving the surface with visible particles residue. On the other hand, excessively large particle are too easily detected visually or provide bad tactile experience while handling or using the cleaner. Therefore, the applicant defines herein an optimal particle size range that delivers both optimal cleaning performance and usage experience.

The abrasive particles have a size defined by their area-equivalent diameter (ISO 9276-6:2008(E) section 7) also called Equivalent Circle Diameter ECD (ASTM F1877-05 Section 11.3.2). Mean ECD of particle population is calculated as the average of respective ECD of each particles of a particle population of at least 10 000 particles, preferably above 50 000 particles, more preferably above 100 000 particles after excluding from the measurement and calculation the data of particles having area-equivalent diameter (ECD) of below 10 micrometers. Mean data are extracted from volume-based vs. number-based measurements.

One suitable way of reducing the nut shell and/or vegetables to the abrasive cleaning particles herein is to grind or mill nut shell and/or vegetables. Other suitable means include the use of eroding tools such as a high speed eroding wheel with dust collector wherein the surface of the wheel is engraved with a pattern or is coated with abrasive sandpaper or the like to promote the nut shell and/or vegetables to form the abrasive cleaning particles herein.

Alternatively the bulk nut shell and/or vegetables can be broken into pieces of a few cm dimensions by manually chopping or cutting, or using a mechanical tool such as a lumpbreaker, for example the Model 2036 from S Howes, Inc. of Silver Creek, N.Y. In a second stage, the lumps are agitated using a propeller or saw toothed disc dispersing tool, which causes the nut shell and/or vegetables to release entrapped water and form liquid slurry of nut shell and/or vegetables particles dispersed in aqueous phase. In a third stage, a high shear mixer (such as the Ultra Turrax rotor stator mixer from IKA Works, Inc., Wilmington, N.C.) can be employed to reduce the particle size of the primary slurry to that required for cleaning particles.

Preferably the abrasive cleaning particles obtained via grinding or milling operation are single particles.

Preferred abrasive cleaning particles in the present invention have hardness from 40 to 90, preferably from 60 to 90, more preferably from 50 to 85 and most preferably from 70 to 80 before being immersed in the liquid cleaning composition, measured according to Shore D hardness scale. The hardness Shore D is measured with a durometer type D according to a procedure described in ASTM D2240

By "hardness of the cleaning particles" herein it is meant hardness of the core material of the abrasive material. Coating material does not have impact on overall hardness.

Alternatively preferred abrasive cleaning particles in the present invention have hardness from 0.2 to 3, preferably from 0.2 to 2 when immersed in the liquid cleaning composition, measured according to MOHS hardness scale. The MOHS hardness scale is an internationally recognized scale for measuring the hardness of a compound versus a compound of known hardness, see Encyclopedia of Chemical Technology, Kirk-Othmer, 4$^{th}$ Edition Vol 1, page 18 or Lide, D. R (ed) CRC Handbook of Chemistry and Physics, 73 rd edition, Boca Raton, Fla.: The Rubber Company, 1992-1993.

The abrasive cleaning particles used in the present invention can be a mixture of bleached nut shell particles or bleached vegetable particles and other suitable abrasive cleaning particles. However all abrasive cleaning particles need to have Shore D hardness scale below or equal to 90 or MOSH hardness below or equal to 3. The other abrasive cleaning particles can be selected from the group consisting of plastics, hard waxes, inorganic and organic abrasives, and natural materials. The other abrasive cleaning particle is substantially insoluble or partially soluble in water. Most preferably the other abrasive component is calcium carbonate or derived from natural vegetable abrasives.

Optional Ingredients

The compositions according to the present invention may comprise a variety of optional ingredients depending on the technical benefit aimed for and the surface treated.

Suitable optional ingredients for use herein include suspending aids, chelating agents, surfactants, radical scavengers, perfumes, surface-modifying polymers, solvents, builders, buffers, bactericides, preservatives, hydrotropes, colorants, stabilizers, bleaches, bleach activators, suds controlling agents like fatty acids, enzymes, soil suspenders, brighteners, anti dusting agents, dispersants, pigments, and dyes.

Suspending Aid

The abrasive cleaning particles present in the composition herein are solid particles in a liquid composition. Said abrasive cleaning particles may be suspended in the liquid composition. However, it is well within the scope of the present invention that such abrasive cleaning particles are not-stably suspended within the composition and either settle or float on top of the composition. In this case, a user may have to temporally suspend the abrasive cleaning particles by agitating (e.g., shaking or stirring) the composition prior to use.

However, it is preferred herein that the abrasive cleaning particles are stably suspended in the liquid compositions herein. Thus the compositions herein comprise a suspending aid.

The suspending aid herein may either be a compound specifically chosen to provide a suspension of the abrasive cleaning particles in the liquid compositions of the present invention, such as a structurant, or a compound that also provides another function, such as a thickener or a surfactant (as described herein elsewhere).

Any suitable organic and inorganic suspending aids typically used as gelling, thickening or suspending agents in cleaning compositions and other detergent or cosmetic compositions may be used herein. Indeed, suitable organic suspending aids include polysaccharide polymers. In addition or as an alternative, polycarboxylate polymer thickeners may be used herein. Also, in addition or as an alternative of the above, layered silicate platelets e.g.: Hectorite, bentonite or montmorillonites can also be used. Suitable commercially available layered silicates are Laponite RD® or Optigel CL® available from Rockwood Additives.

Suitable polycarboxylate polymer thickeners include (preferably lightly) crosslinked polyacrylate. A particularly suitable polycarboxylate polymer thickeners is Carbopol commercially available from Lubrizol under the trade name Carbopol 674®.

Suitable polysaccharide polymers for use herein include substituted cellulose materials like carboxymethylcellulose, ethyl cellulose, hydroxyethyl cellulose, hydroxypropyl cellulose, hydroxymethyl cellulose; micro fibril cellulose (MFC) such as described in US 2008/0108714 (CP Kelco) or US2010/0210501 (P&G), succinoglycan and naturally occurring polysaccharide polymers like Xanthan gum, gellan gum, guar gum, locust bean gum, tragacanth gum, succinoglucan gum, or derivatives thereof, or mixtures thereof. Xanthan gum is commercially available from Kelco under the tradename Kelzan T.

Preferably the suspending aid herein is Xanthan gum. In an alternative embodiment, the suspending aid herein is a polycarboxylate polymer thickeners preferably a (preferably lightly) crosslinked polyacrylate. In a highly preferred embodiment herein, the liquid compositions comprise a combination of a polysaccharide polymer or a mixture thereof, preferably Xanthan gum, with a polycarboxylate polymer or a mixture thereof, preferably a crosslinked polyacrylate.

As a preferred example, Xanthan gum is preferably present at levels between 0.1% to 5%, more preferably 0.5% to 2%, even more preferably 0.8% to 1.2%, by weight of the total composition.

Organic Solvent

As an optional but highly preferred ingredient the composition herein comprises an organic solvents or mixtures thereof.

The compositions herein comprise from 0% to 30%, more preferably about 1.0% to about 20% and most preferably, about 2% to about 15% by weight of the total composition of an organic solvent or a mixture thereof.

Suitable solvents can be selected from the group consisting of: aliphatic alcohols, ethers and diethers having from about 4 to about 14 carbon atoms, preferably from about 6 to about 12 carbon atoms, and more preferably from about 8 to about 10 carbon atoms; glycols or alkoxylated glycols; glycol ethers; alkoxylated aromatic alcohols; aromatic alcohols; terpenes; and mixtures thereof. Aliphatic alcohols and glycol ether solvents are most preferred.

Aliphatic alcohols, of the formula R—OH wherein R is a linear or branched, saturated or unsaturated alkyl group of from about 1 to about 20 carbon atoms, preferably from about 2 to about 15 and more preferably from about 5 to about 12, are suitable solvents. Suitable aliphatic alcohols are methanol, ethanol, propanol, isopropanol or mixtures thereof. Among aliphatic alcohols, ethanol and isopropanol are most preferred because of their high vapour pressure and tendency to leave no residue.

Suitable glycols to be used herein are according to the formula HO—$CR_1R_2$—OH wherein R1 and R2 are independently H or a $C_2$-$C_{10}$ saturated or unsaturated aliphatic hydrocarbon chain and/or cyclic. Suitable glycols to be used herein are dodecaneglycol and/or propanediol.

In one preferred embodiment, at least one glycol ether solvent is incorporated in the compositions of the present invention. Particularly preferred glycol ethers have a terminal $C_3$-$C_6$ hydrocarbon attached to from one to three ethylene glycol or propylene glycol moieties to provide the appropriate degree of hydrophobicity and, preferably, surface activity. Examples of commercially available solvents based on ethylene glycol chemistry include mono-ethylene glycol n-hexyl ether (Hexyl Cellosolve®) available from Dow Chemical. Examples of commercially available solvents based on propylene glycol chemistry include the di-, and tri-propylene glycol derivatives of propyl and butyl alcohol, which are available from Arco under the trade names Arcosolv® and Dowanol®.

In the context of the present invention, preferred solvents are selected from the group consisting of mono-propylene glycol mono-propyl ether, di-propylene glycol mono-propyl ether, mono-propylene glycol mono-butyl ether, di-propylene glycol mono-propyl ether, di-propylene glycol mono-butyl ether; tri-propylene glycol mono-butyl ether; ethylene glycol mono-butyl ether; di-ethylene glycol mono-butyl ether, ethylene glycol mono-hexyl ether and di-ethylene glycol mono-hexyl ether, and mixtures thereof. "Butyl" includes normal butyl, isobutyl and tertiary butyl groups. Mono-propylene glycol and mono-propylene glycol mono-butyl ether are the most preferred cleaning solvent and are available under the tradenames Dowanol DPnP® and Dowanol DPnB®. Di-propylene glycol mono-t-butyl ether is commercially available from Arco Chemical under the tradename Arcosolv PTB®.

In a particularly preferred embodiment, the cleaning solvent is purified so as to minimize impurities. Such impurities include aldehydes, dimers, trimers, oligomers and other by-products. These have been found to deleteriously affect product odour, perfume solubility and end result. The inventors have also found that common commercial solvents, which contain low levels of aldehydes, can cause irreversible and irreparable yellowing of certain surfaces. By purifying the cleaning solvents so as to minimize or eliminate such impurities, surface damage is attenuated or eliminated.

Though not preferred, terpenes can be used in the present invention. Suitable terpenes to be used herein monocyclic terpenes, dicyclic terpenes and/or acyclic terpenes. Suitable terpenes are: D-limonene; pinene; pine oil; terpinene; terpene derivatives as menthol, terpineol, geraniol, thymol; and the citronella or citronellol types of ingredients.

Suitable alkoxylated aromatic alcohols to be used herein are according to the formula R-$(A)_n$-OH wherein R is an alkyl substituted or non-alkyl substituted aryl group of from about 1 to about 20 carbon atoms, preferably from about 2 to about 15 and more preferably from about 2 to about 10, wherein A is an alkoxy group preferably butoxy, propoxy and/or ethoxy, and n is an integer of from about 1 to about 5, preferably about 1 to about 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from about 1 to about 20 carbon atoms, preferably from about 1 to about 15 and more preferably from about 1 to about 10. For example a suitable aromatic alcohol to be used herein is benzyl alcohol.

Surfactants

The compositions herein may comprise nonionic, anionic, zwitterionic, amphoteric, cationic surfactants or mixtures thereof. Suitable surfactants are those selected from the group consisting of nonionic, anionic, zwitterionic, cationic and amphoteric surfactants, having hydrophobic chains containing from 8 to 20 carbon atoms. Examples of suitable surfactants are described in McCutcheon's Vol. 1: Emulsifiers and Detergents, North American Ed., McCutcheon Division, MC Publishing Co., 2002.

Preferably, the composition herein comprises from 0.01% to 50%, more preferably from 0.5% to 40%, and most preferably from 1% to 36% by weight of the total composition of a surfactant or a mixture thereof.

Non-limiting examples of suitable non-ionic surfactants include alcohol alkoxylates, alkyl polysaccharides, amine oxides, block copolymers of ethylene oxide and propylene oxide, fluoro surfactants and silicon based surfactants. Non-ionic surfactant, when present as co-surfactant, is comprised in a typical amount of from 0.01% to 15%, preferably 0.1% to 12%, more preferably from 0.5% to 10% by weight of the liquid detergent composition. When present as main surfactant, it is comprised in a typical amount of from 0.8% to 40%, preferably 1% to 38%, more preferably 2% to 35% by weight of the total composition.

A preferred class of non-ionic surfactants suitable for the present invention is alkyl ethoxylates. The alkyl ethoxylates of the present invention are either linear or branched, primary or secondary, and contain from 8 carbon atoms to 22 carbon atoms in the hydrophobic tail, and from 1 ethylene oxide units to 25 ethylene oxide units in the hydrophilic head group. Examples of alkyl ethoxylates include Neodol 91-6®, Neodol 91-8® supplied by the Shell Corporation (P.O. Box 2463, 1 Shell Plaza, Houston, Tex.), and Alfonic 810-60® supplied by Condea Corporation, (900 Threadneedle P.O. Box 19029, Houston, Tex.). More preferred alkyl ethoxylates comprise from 9 to 15 carbon atoms in the hydrophobic tail, and from 4 to 12 oxide units in the hydrophilic head group. A most preferred alkyl ethoxylate is $C_{9-11}$ $EO_5$, available from the Shell Chemical Company under the tradename Neodol 91-5®. Non-ionic ethoxylates can also be derived from branched alcohols. For example, alcohols can be made from branched olefin feedstocks such as propylene or butylene. In a preferred embodiment, the branched alcohol is either a 2-propyl-1-heptyl alcohol or 2-butyl-1-octyl alcohol. A desirable branched alcohol ethoxylate is 2-propyl-1-heptyl EO7/AO7, manufactured and sold by BASF Corporation under the tradename Lutensol XP 79/XL 79®.

Another preferred class of non-ionic surfactant suitable for the present invention is amine oxide, especially coco dimethyl amine oxide or coco amido propyl dimethyl amine oxide. Amine oxide may have a linear or mid-branched alkyl moiety. Typical linear amine oxides include water-soluble amine oxides of formula $R^1$—$N(R^2)(R^3)$→O wherein $R^1$ is a $C_{8-18}$ alkyl moiety; $R^2$ and $R^3$ are independently selected from the group consisting of $C_{1-3}$ alkyl groups and $C_{1-3}$ hydroxyalkyl groups and preferably include methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Another class of non-ionic surfactant suitable for the present invention is alkyl polysaccharides. Such surfactants are disclosed in U.S. Pat. Nos. 4,565,647, 5,776,872, 5,883,062, and 5,906,973. Among alkyl polysaccharides, alkyl polyglycosides comprising five and/or six carbon sugar rings are preferred, those comprising six carbon sugar rings are more preferred, and those wherein the six carbon sugar ring is derived from glucose, i.e., alkyl polyglucosides ("APG"), are most preferred. The alkyl substituent in the APG chain length is preferably a saturated or unsaturated alkyl moiety containing from 8 to 16 carbon atoms, with an average chain length of 10 carbon atoms. $C_8$-$C_{16}$ alkyl polyglucosides are commercially available from several suppliers (e.g., Simusol® surfactants from Seppic Corporation, 75 Quai d'Orsay, 75321 Paris, Cedex 7, France, and Glucopon 220®, Glucopon 225®, Glucopon 425®, Plantaren 2000 N®, and Plantaren 2000 N UP®, from Cognis Corporation, Postfach 13 01 64, D 40551, Dusseldorf, Germany). Also suitable are alkylglycerol ethers and sorbitan esters.

Another class of non-ionic surfactant suitable for the present invention is fatty acid amide surfactants comprising an alkyl group containing from 7 to 21, preferably from 9 to 17, carbon atoms. Preferred amides are $C_8$-$C_{20}$ ammonia amides, monoethanolamides, diethanolamides, and isopropanolamides.

Other non-ionic surfactants that can be used include those derived from natural sources such as sugars and include $C_8$-$C_{16}$ N-alkyl glucose amide surfactants.

Alternative non-ionic detergent surfactants for use herein are alkoxylated alcohols generally comprising from 8 to 16 carbon atoms in the hydrophobic alkyl chain of the alcohol. Typical alkoxylation groups are propoxy groups or ethoxy groups in combination with propoxy groups, yielding alkyl ethoxy propoxylates. Such compounds are commercially available under the tradename Antarox® available from Rhodia (40 Rue de la Haie-Coq F-93306, Aubervilliers Cédex, France) and under the tradename Nonidet® available from Shell Chemical.

The condensation products of ethylene oxide with a hydrophobic base formed by the condensation of propylene oxide with propylene glycol are also suitable for use herein. The hydrophobic portion of these compounds will preferably have a molecular weight of from 1500 to 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to 40 moles of ethylene oxide. Examples of compounds of this type include certain of the commercially available Pluronic® surfactants, marketed by BASF. Chemically, such surfactants have the structure $(EO)_x(PO)_y(EO)_z$ or $(PO)_x(EO)_y(PO)_z$ wherein x, y, and z are from 1 to 100, preferably 3 to 50. Pluronic® surfactants known to be good wetting surfactants are more preferred. A description of the Pluronic® surfactants, and properties thereof, including wetting properties, can be found in the brochure entitled "BASF Performance Chemicals Plutonic® & Tetronic® Surfactants", available from BASF.

Other suitable though not preferred non-ionic surfactants include the polyethylene oxide condensates of alkyl phenols, e.g., the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds can be derived from oligomerized propylene, diisobutylene, or from other sources of iso-octane n-octane, iso-nonane or n-nonane.

Suitable anionic surfactants for use herein are all those commonly known by those skilled in the art. The anionic surfactants for use herein include alkyl sulphonates, alkyl aryl sulphonates, alkyl sulphates, alkyl alkoxylated sulphate surfactants, $C_6$-$C_{20}$ alkyl alkoxylated linear or branched diphenyl oxide disulphonates, or mixtures thereof.

When present in the composition anionic surfactant can be incorporated in the compositions herein in amounts ranging from 0.01% to 50%, preferably 0.5% to 40%, more preferably 2% to 35%.

Suitable sulphate surfactants for use in the compositions herein include water-soluble salts or acids of $C_{10}$-$C_{14}$ alkyl or hydroxyalkyl, sulphate and/or ether sulfate. Suitable counterions include hydrogen, alkali metal cation or ammonium or substituted ammonium, but preferably sodium. Where the hydrocarbyl chain is branched, it preferably comprises $C_{1-4}$ alkyl branching units. The average percentage branching of the sulphate surfactant is preferably greater than 30%, more preferably from 35% to 80% and most preferably from 40% to 60% of the total hydrocarbyl chains.

The sulphate surfactants may be selected from $C_8$-$C_{20}$ primary, branched-chain and random alkyl sulphates (AS); $C_{10}$-$C_{18}$ secondary (2,3)alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303.

Suitable alkyl alkoxylated sulphate surfactants for use herein are according to the formula $RO(A)_mSO_3M$ wherein R is an unsubstituted $C_6$-$C_{20}$ alkyl or hydroxyalkyl group having a $C_6$-$C_{20}$ alkyl component, preferably a $C_8$-$C_{20}$ alkyl or hydroxyalkyl, more preferably $C_{10}$-$C_{18}$ alkyl or hydroxyalkyl, A is an ethoxy or propoxy unit, m is greater than zero, typically between 0.5 and 6, more preferably between 0.5 and 5, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}E(1.0)SM$), $C_{12}$-$C_{18}$ alkyl polyethoxylate (2.25) sulfate ($C_{12}$-$C_{18}E(2.25)SM$), $C_{12}$-$C_{18}$ alkyl polyethoxylate (3.0) sulfate ($C_{12}$-$C_{18}E(3.0)SM$), $C_{12}$-$C_{18}$ alkyl polyethoxylate (4.0) sulfate ($C_{12}$-$C_{18}E$, (4.0)SM), wherein M is conveniently selected from sodium and potassium.

Suitable alkyl sulphonates for use herein include water-soluble salts or acids of the formula $RSO_3M$ wherein R is a $C_6$-$C_{20}$ linear or branched, saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). Particularly suitable liner alkyl sulphonates include $C_{12}$-$C_{16}$ paraffin sulphonate like Hostapur® SAS commercially available from Hoechst.

Suitable alkyl aryl sulphonates for use herein include water-soluble salts or acids of the formula $RSO_3M$ wherein R is an aryl, preferably a benzyl, substituted by a $C_6$-$C_{20}$ linear or branched saturated or unsaturated alkyl group, preferably a $C_8$-$C_{18}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like). An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

Suitable $C_6$-$C_{20}$ alkyl alkoxylated linear or branched diphenyl oxide disulphonate surfactants for use herein are according to the following formula:

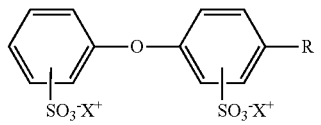

wherein R is a $C_6$-$C_{20}$ linear or branched, saturated or unsaturated alkyl group, preferably a $C_{12}$-$C_{18}$ alkyl group and more preferably a $C_{14}$-$C_{16}$ alkyl group, and X+ is H or a cation, e.g., an alkali metal cation (e.g., sodium, potassium, lithium, calcium, magnesium and the like). Particularly suitable $C_6$-$C_{20}$ alkyl alkoxylated linear or branched diphenyl oxide disulphonate surfactants to be used herein are the $C_{1-2}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful herein include salts (including, for example, sodium, potassium, ammonium, and substituted ammonium salts such as mono-, di- and triethanolamine salts) of soap, $C_8$-$C_{24}$ olefinsulfonates, sulphonated polycarboxylic acids prepared by sulphonation of the pyrolyzed product of alkaline earth metal citrates, e.g., as described in British patent specification No. 1,082,179, $C_8$-$C_{24}$ alkylpolyglycolethersulfates (containing up to 10 moles of ethylene oxide); alkyl ester sulfonates such as $C_{14}$-$C_{16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), alkyl polyethoxy carboxylates such as those of the formula $RO(CH_2CH_2O)_k CH_2COO^-M^+$ wherein R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Zwitterionic surfactants represent another class of preferred surfactants within the context of the present invention. When present in the composition, zwitteronic surfactants may be comprised at levels from 0.01% to 20%, preferably from 0.2% to 15%, more preferably 0.5% to 12%. Zwitterionic surfactants contain both cationic and anionic groups on the same molecule over a wide pH range. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Some common examples of these detergents are described in the patent literature: U.S. Pat. Nos. 2,082,275, 2,702,279 and 2,255,082.

Suitable zwitteronic surfactants include betaines such alkyl betaines, alkylamidobetaine, amidazoliniumbetaine, sulfobetaine (INCI Sultaines) as well as the Phosphobetaine and preferably meets formula I:

$R^1$—[CO—X $(CH_2)_n]_x$—$N^+(R^2)(R^3)$—$(CH_2)_m$-[CH(OH)—$CH_2]_y$—Y—(I) wherein $R^1$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue;

X is NH, $NR^4$ with $C_{14}$ Alkyl residue $R^4$, O or S, n a number from 1 to 10, preferably 2 to 5, in particular 3, x 0 or 1, preferably 1, $R^2$, $R^3$ are independently a $C_{1-4}$ alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido betaine of the formula (Ib), the sulfo betaines of the formula (Ic) and the amido sulfobetaine of the formula (Id);

$$R^1—N^+(CH_3)_2—CH_2COO^- \quad (Ia)$$

$$R^1—CO—NH(CH_2)_3—N^+(CH_3)_2—CH_2COO^- \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3^- \quad (Id)$$

in which $R^1$ has the same meaning as in formula I. Particularly preferred betaines are the Carbobetaine [wherein $Y^-$=$COO^-$], in particular the carbobetaine of the formula (Ia) and (Ib), more preferred are the alkylamidobetaine of the formula (Ib).

Examples of suitable betaines and sulfobetaine are the following: almondamidopropyl betaine, Apricotamidopropyl betaine, avocadoamidopropyl betaine, babassuamidopropyl betaine, behen amidopropyl betaine, behenyl betaine, canolamidopropyl betaine, capryl/capramidopropyl betaine, carnitine, cetylbetaine, cocamidoethyl betaine, cocamidopropyl betaine, cocamidopropyl hydroxysultaine, cocobetaine, cocohydroxysultaine, coco/oleamidopropyl betaine, coco sultaine, decyl betaine, dihydroxyethyloleylglycinate, dihydroxyethylstearylglycinate, dihydroxyethyl tallow glycinate, dimethicone propyl pg-betaine, erucamidopropyl hydroxysultaine, hydrogenated tallow betaine, isostearamidopropyl betaine, lauramidopropyl betaine, lauryl betaine, lauryl hydroxysultaine, lauryl sultaine, milkamidopropyl betaine, minkamidopropyl betaine, myristamidopropyl betaine, myristyl betaine, oleamidopropyl betaine, oleamidopropyl hydroxysultaine, oleyl betaine, olivamidopropyl betaine, palmamidopropyl betaine, palmitamidopropyl betaine, palmitoyl carnitine, palmkernelamidopropyl betaine, polytetrafluoroethylene acetoxypropyl betaine, ricinoleic amidopropyl betaine, sesamidopropyl betaine, soyamidopropyl betaine, stearamidopropyl betaine, stearyl betaine, tallow amidopropyl betaine, tallow amidopropyl hydroxysultaine, tallow betaine, tallow dihydroxyethyl betaine, undecylenamidopropyl betaine and wheat germ amidopropyl betaine. Preferred betaine is for example cocamidopropyl betaine.

A specific example of a zwitterionic surfactant is 3-(N-dodecyl-N,N-dimethyl)-2-hydroxypropane-1-sulfonate (Lauryl hydroxyl sultaine) available from the McIntyre Company (24601 Governors Highway, University Park, Ill. 60466, USA) under the tradename Mackam LHS®. Another specific zwitterionic surfactant is $C_{12-14}$ acylamidopropylene (hydroxypropylene) sulfobetaine that is available from McIntyre under the tradename Mackam 50-SB®. Other very useful zwitterionic surfactants include hydrocarbyl, e.g., fatty alkylene betaines. A highly preferred zwitterionic surfactant is Empigen BB®, a coco dimethyl betaine produced by Albright & Wilson. Another equally preferred zwitterionic surfactant is Mackam 35HP®, a coco amido propyl betaine produced by McIntyre.

Another class of preferred surfactants comprises the group consisting of amphoteric surfactants. One suitable amphoteric surfactant is a $C_8$-$C_{16}$ amido alkylene glycinate surfactant ('ampho glycinate'). Another suitable amphoteric surfactant is a $C_8$-$C_{16}$ amido alkylene propionate surfactant ('ampho propionate'). Other suitable, amphoteric surfactants are represented by surfactants such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol®", and described in U.S. Pat. No. 2,528,378.

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is an $C_6$-$C_{18}$ alkyl or alkenyl ester of a quaternary ammonium alcohol, such as quaternary chlorine esters.

Chelating Agents

One class of optional compounds for use herein includes chelating agents or mixtures thereof. Chelating agents can be incorporated in the compositions herein in amounts ranging from 0.0% to 10.0% by weight of the total composition, preferably 0.01% to 5.0%.

Suitable phosphonate chelating agents for use herein may include alkali metal ethane 1-hydroxy diphosphonates (HEDP), alkylene poly(alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS and methyl glycine di-acetic acid (MGDA).

Further carboxylate chelating agents for use herein include salicylic acid, aspartic acid, glutamic acid, glycine, malonic acid or mixtures thereof.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 10% by weight of the total composition and preferably from 0.001% to 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13. The compositions herein may comprise a perfume ingredient, or mixtures thereof, in amounts up to 5.0% by weight of the total composition, preferably in amounts of 0.1% to 1.5%.

Dye

The liquid compositions according to the present invention may be coloured. Accordingly, they may comprise a dye or a mixture thereof.

Preservatives

The liquid compositions according to present invention may comprise preservatives to prevent bio-growth potentially coming from the natural abrasive.

Delivery Form of the Compositions

The compositions herein may be packaged in a variety of suitable packaging known to those skilled in the art, such as plastic bottles for pouring liquid compositions, squeeze bottles or bottles equipped with a trigger sprayer for spraying liquid compositions. Alternatively, the paste-like compositions according to the present invention may by packaged in a tube.

In an alternative embodiment herein, the liquid composition herein is impregnated onto a substrate, preferably the substrate is in the form of a flexible, thin sheet or a block of material, such as a sponge.

Suitable substrates are woven or non-woven sheets, cellulosic material based sheets, sponge or foam with open cell structures e.g.: polyurethane foams, cellulosic foam, melamine foam, etc.

The Process of Cleaning a Surface

The present invention encompasses a process of cleaning a surface with a liquid composition according to the present invention. Suitable surfaces herein are described herein above under the heading "The liquid cleaning composition".

In a preferred embodiment said surface is contacted with the composition according to the present invention, preferably wherein said composition is applied onto said surface.

In another preferred embodiment, the process herein comprises the steps of dispensing (e.g., by spraying, pouring, squeezing) the liquid composition according to the present invention from a container containing said liquid composition and thereafter cleaning said surface.

The composition herein may be in its neat form or in its diluted form.

By "in its neat form", it is to be understood that said liquid composition is applied directly onto the surface to be treated without undergoing any dilution, i.e., the liquid composition herein is applied onto the surface as described herein.

By "diluted form", it is meant herein that said liquid composition is diluted by the user typically with water. The liquid composition is diluted prior to use to a typical dilution level of up to 10 times its weight of water. A usually recommended dilution level is a 10% dilution of the composition in water.

The composition herein may be applied using an appropriate implement, such as a mop, paper towel, brush or a cloth, soaked in the diluted or neat composition herein. Furthermore, once applied onto said surface said composition may be agitated over said surface using an appropriate implement. Indeed, said surface may be wiped using a mop, paper towel, brush or a cloth.

The process herein may additionally contain a rinsing step, preferably after the application of said composition. By "rinsing", it is meant herein contacting the surface cleaned/cleansed with the process according to the present invention with substantial quantities of appropriate solvent, typically water, directly after the step of applying the liquid composition herein onto said surface.

By "substantial quantities", it is meant herein between 0.01 lt. and 1 lt. of water per $m^2$ of surface, more preferably between 0.1 lt. and 1 lt. of water per $m^2$ of surface.

EXAMPLES

These following compositions were made comprising the listed ingredients in the listed proportions (weight %). Examples 1-19 are made with coated walnut particles, alternatively coated vegetable particles could be used. Examples 1-19 herein are met to exemplify the present invention but are not necessarily used to limit or otherwise define the scope of the present invention.

Hard Surface Cleaner Bathroom Composition:

| % Weight | 1 | 2 | 3 |
|---|---|---|---|
| C9-C11 EO8 (Neodol 91-8 ®) | 3 | 2.5 | 3.5 |
| Alkyl Benzene sulfonate | | 1 | |
| C12-14-dimethyl Aminoxide | | 1 | |
| n-Butoxy Propoxy Propanol | | 2 | 2.5 |
| Hydrogene Peroxide | 3 | | |
| Hydrophobic ethoxylated polyurethane (Acusol 882 ®) | 1.5 | 1 | 0.8 |
| Lactic Acid | 3 | | 3.5 |
| Citric Acid | | 3 | 0.5 |
| Polysaccharide (Xanthan Gum, Keltrol CG-SFT ® Kelco) | 0.25 | 0.25 | 0.25 |
| Perfume | 0.35 | 0.35 | 0.35 |
| coated walnut shell particles with 10% coating mix (25% $TiO_2$/75% crystalline wax) | 1 | 1 | 1 |
| Water | Balance | Balance | Balance |

Hard Surface Cleaner Bathroom Composition (Cont.):

| % Weight | 4 | 5 | 6 |
|---|---|---|---|
| Chloridric acid | 2 | | |
| Linear C10 alkyl sulphate | 1.3 | 2 | 3 |
| n-Butoxy Propoxy Propanol | 2 | | 1.75 |
| Citric Acid | | 3 | 3 |
| PolyvinylPyrrolidone (Luviskol K60 ®) | 0.1 | 0.1 | 0.1 |
| NaOH | | 0.2 | 0.2 |
| Perfume | 0.4 | 0.4 | 0.4 |
| Polysaccharide (Xanthan Gum Kelzan T ®, Kelco) | 0.3 | 0.35 | 0.35 |
| coated walnut shell particles with 10% coating mix (25% $TiO_2$/75% crystalline wax) | 2 | 2 | 2 |
| Water | Balance | Balance | Balance |

Hand-Dishwashing Detergent Compositions:

| % Weight | 7 | 8 | 9 |
|---|---|---|---|
| N-2-ethylhexyl sulfocuccinamate | 3 | 3 | 3 |
| C11EO5 | 7 | 14 | |
| C11-EO7 | | | 7 |
| C10-EO7 | 7 | | 7 |
| Trisodium Citrate | 1 | 1 | 1 |
| Potassium Carbonate | 0.2 | 0.2 | 0.2 |
| Perfume | 1 | 1 | 1 |
| Polysaccharide (Xanthan Gum Kelzan T ®, Kelco) | 0.35 | 0.35 | 0.35 |
| coated walnut shell particles with 10% coating mix (25% $TiO_2$/75% crystalline wax) | 2 | 2 | 2 |
| Water (+ minor e.g.; pH adjusted to 10.5) | Balance | Balance | Balance |

General Degreaser Composition:

| % Weight | 10 | 11 |
|---|---|---|
| C9-C11 EO8 (Neodol 91-8 ®) | 3 | 3 |
| N-Butoxy Propoxy Propanol | 15 | 15 |
| Ethanol | 10 | 5 |
| Isopropanol | | 10 |
| Polysaccharide (Xanthan Gum-glyoxal modified Optixan-T) | 0.35 | 0.35 |
| coated Olive stone particles with 5% coating mix (25% $TiO_2$/75% crystalline wax) | 1 | 1 |
| Water (+ minor e.g.; pH adjusted to alkaline pH) | Balance | Balance |

Scouring Composition:

| % Weight | 12 | 13 | 14 |
|---|---|---|---|
| Sodium C13-16 prafin sulfonate | 2.5 | 2.5 | 2.5 |
| C12-14-EO7 (Lutensol AO7 ®) | 0.5 | 0.5 | 0.5 |
| Coconut Fatty Acid | 0.3 | 0.3 | 0.3 |
| Sodium Citrate | 3.3 | 3.3 | 3.3 |
| Sodium Carbonate | 3 | 3 | 3 |
| Orange terpenes | 2.1 | 2.1 | 2.1 |
| Benzyl Alcohol | 1.5 | 1.5 | |
| Polyacrylic acid 1.5 Mw | 0.75 | 0.75 | 0.75 |
| Diatomaceous earth (Celite 499 ® median size 10 μm) | 25 | | |
| Calcium Carbonate (Merk 2066 ® median size 10 μm) | | 25 | |
| coated Olive stone particles with 2.5% coating mix (25% $TiO_2$/75% crystalline wax) | 5 | 5 | 5 |
| Water | Balance | Balance | Balance |

Liquid Glass Cleaner:

| % Weight | 15 | 16 |
|---|---|---|
| Butoxypropanol | 2 | 4 |
| Ethanol | 3 | 6 |
| C12-14 sodium sulphate | 0.24 | |
| NaOH/Citric acid | To pH 10 | |
| Citric Acid | | |
| coated walnut shell particles with 5% coating mix (25% $TiO_2$/75% cristallin wax) | 0.5 | 0.5 |
| Water (+minor) | Balance | Balance |

Cleaning Wipe (Surface Cleaning Wipe):

| % Weight | 17 | 18 | 19 |
|---|---|---|---|
| C10 Amine Oxide | — | 0.02 | — |
| C12,14 Amine Oxide | 0.4 | — | — |
| Betaine (Rewoteric AM CAS 15 U) | — | — | 0.2 |
| C9,11 A5EO (Neodol E 91.5 ®) | — | 0.1 | — |
| C9,11 A8EO (Neodol E 91.8 ®) | — | — | 0.8 |
| C12,14 A5EO | 0.125 | — | — |
| 2-Ethyl Hexyl Sulphate | — | 0.05 | 0.6 |
| Silicone | 0.001 | 0.003 | 0.003 |
| EtOH | 9.4 | 8.0 | 9.5 |
| Propylene Glycol Butyl Ether | 0.55 | 1.2 | — |
| Geraniol | — | — | 0.1 |
| Citric acid | 1.5 | — | — |
| Lactic acid | — | | 1.5 |
| Perfume | 0.25 | 0.15 | 0.15 |
| coated walnut shell particles with 10% coating mix (25% $TiO_2$/75% cristallin wax) | 5 | 3 | 3 |
| Nonwoven:Spunlace 100% viscose 50 gsm (lotion loading fact) | | | (x3.5) |
| Nonwoven:Airlaid walkisoft (70% cellulose, 12% Viscose, 18% binder) 80 gsm (lotion loading factor) | | (x3.5) | |
| Carded thermobonded (70% polypropylene, 30% rayon), 70 gsm (Lotion loading factor) | (x3.5) | | |

The above wipes lotion composition is loaded onto a water-insoluble substrate, being a patterned hydroentangled nonwoven substrate having a basis weight of 56 gms comprising 70% polyester and 30% rayon approximately 6.5 inches wide by 7.5 inches long with a caliper of about 0.80 mm. Optionally, the substrate can be pre-coated with dimethicone (Dow Corning 200 Fluid 5 cst) using conventional substrate coating techniques. Lotion to wipe weight ratio of about 2:1 using conventional substrate coating techniques.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid cleaning composition comprising from 0.01% to 50% by weight of a surfactant or a mixture thereof; coated cleaning particles as abrasives having a coating material layer thickness of from about 1 micron to about 40 microns, wherein said coating material layer contains whitening pigments selected from the group consisting of titanium dioxide, kaolin, calcium carbonate, and mixtures thereof, wherein coated cleaning particles are selected from the group consisting of coated nut shell particles, coated particles derived from other plant parts selected from the group consisting of stems, roots, leaves, seeds, and mixtures thereof, coated wood particles and mixtures thereof, and wherein coated abrasive cleaning particles have a degree of whiteness (L*) of greater than about 65, measured under D 65 illumination.

2. A liquid cleaning composition according to claim 1, wherein nut shell particles are walnut shell particles or pistachio nut shell particles.

3. A liquid cleaning composition according to claim 1, wherein particles derived from other plant parts are derived from rice, corn cob, palm biomass, bamboo, kenaf, apple seeds, apricot stone, olive stone and mixtures thereof.

4. A liquid cleaning composition according to claim 1, wherein said coating material layer is from 1 micron to about 20 microns.

5. A liquid cleaning composition according to claim 1, wherein said coating material layer is from 1 micron to about 10 microns.

6. A liquid cleaning composition according to claim 1, wherein said whitening pigments are bound to the particle via polymeric or resin coating.

7. A liquid cleaning composition according claim 1, further comprising a suspending aid selected from the group consisting of polycarboxylate polymer thickeners, carboxymethylcellulose, ethyl cellulose, hydroxyethyl cellulose, hydroxypropyl cellulose, hydroxymethyl cellulose, succinoglycan, Xanthan gum, gellan gum, guar gum, locust bean gum, tragacanth gum, succinoglucan gum, and mixtures thereof.

8. A liquid cleaning composition according to claim 1, wherein said composition comprises coated walnut particles from about 0.1%, to about 20 by weight of the composition.

9. A liquid cleaning composition according to claim 1, wherein said composition comprises coated walnut particles from about 0.5% to about 3% by weight of the composition.

10. A liquid cleaning composition according claim 6, wherein said composition has a pH from about 6 to about 8.

11. A liquid cleaning composition according claim 6, wherein said composition has a pH from about 6.5 to about 7.5.

12. A liquid cleaning composition according to claim 10, wherein said abrasive particles have a mean particle size as expressed by the area-equivalent diameter from about 10 to about 1000 μm according to ISO 9276-6.

13. A liquid cleaning composition according to claim 10, wherein said abrasive particles have a mean particle size as expressed by the area-equivalent diameter from about 150 to about 250 μm according to ISO 9276-6.

14. A liquid cleaning composition according claim 1, wherein water is present in an amount exceeding about 30% by weight of total liquid composition.

15. A liquid cleaning composition according to claim 14, wherein the cleaning composition is loaded on a cleaning substrate, and wherein the substrate is a paper or nonwoven towel or wipe or a sponge.

16. A process of cleaning a surface with the a liquid, cleaning composition according to claim 14, wherein said surface is contacted with said composition, wherein said composition is applied onto said surface.

17. A process according to claim 16, wherein said surface is an inanimate surface, selected from the group consisting of household hard surfaces; dish surfaces; leather synthetic leather; and automotive vehicles surfaces.

* * * * *